US011142813B2

(12) United States Patent
Nakajima et al.

(10) Patent No.: US 11,142,813 B2
(45) Date of Patent: Oct. 12, 2021

(54) NON-ORIENTED ELECTRICAL STEEL SHEET AND MANUFACTURING METHOD THEREFOR

(71) Applicant: JFE STEEL CORPORATION, Tokyo (JP)

(72) Inventors: Hiroaki Nakajima, Tokyo (JP); Masanori Uesaka, Tokyo (JP); Yoshiaki Zaizen, Tokyo (JP); Tomoyuki Okubo, Tokyo (JP); Yoshihiko Oda, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 227 days.

(21) Appl. No.: 16/463,412

(22) PCT Filed: Nov. 15, 2017

(86) PCT No.: PCT/JP2017/041113
§ 371 (c)(1),
(2) Date: May 23, 2019

(87) PCT Pub. No.: WO2018/097006
PCT Pub. Date: May 31, 2018

(65) Prior Publication Data

US 2020/0190639 A1 Jun. 18, 2020

(30) Foreign Application Priority Data

Nov. 25, 2016 (JP) ..... JP2016-229113

(51) Int. Cl.
*C22C 38/02* (2006.01)
*C22C 38/04* (2006.01)
(Continued)

(52) U.S. Cl.
CPC ..... *C22C 38/02* (2013.01); *B21C 47/02* (2013.01); *C21D 8/0205* (2013.01);
(Continued)

(58) Field of Classification Search
CPC ..... C21D 6/005; C21D 6/008; C21D 8/005; C21D 8/0205; C21D 8/0263;
(Continued)

(56) References Cited

U.S. PATENT DOCUMENTS 8,177,920 B2 5/2012 Shingaki et al.
9,637,812 B2 5/2017 Kubota
(Continued)

FOREIGN PATENT DOCUMENTS

CN 1784504 A 6/2006
CN 101048523 A 10/2007
(Continued)

OTHER PUBLICATIONS

Feb. 13, 2018, International Search Report issued in the International Patent Application No. PCT/JP2017/041113.
(Continued)

*Primary Examiner* — Vanessa T. Luk
(74) *Attorney, Agent, or Firm* — Kenja IP Law PC

(57) ABSTRACT

Disclosed is a non-oriented electrical steel sheet low in iron loss that is substantially free of Al and contains large amounts of Si and Mn. The disclosed non-oriented electrical steel sheet has a chemical composition containing C: 0.0050% or less, Si: 2.0% to 6.0%, Mn: 1.0% to 3.0%, P: 0.20% or less, S: 0.0050% or less, N: 0.0050% or less, and Al: 0.0050 % or less, with the balance being Fe and inevitable impurities, in which Si—Mn nitrides having an average diameter of 50 nm to 500 nm has a number density of $1/\mu m^3$ or less.

20 Claims, 4 Drawing Sheets

(51) Int. Cl.

| | |
|---|---|
| ***C21D 8/12*** | (2006.01) |
| ***B21C 47/02*** | (2006.01) |
| ***C21D 8/02*** | (2006.01) |
| ***C22C 38/00*** | (2006.01) |
| ***C22C 38/06*** | (2006.01) |
| ***C22C 38/10*** | (2006.01) |
| ***C22C 38/60*** | (2006.01) |

(52) U.S. Cl.
CPC ..... *C21D 8/1222* (2013.01); *C21D 8/1233* (2013.01); *C21D 8/1272* (2013.01); *C22C 38/001* (2013.01); *C22C 38/005* (2013.01); *C22C 38/008* (2013.01); *C22C 38/04* (2013.01); *C22C 38/06* (2013.01); *C22C 38/105* (2013.01); *C22C 38/60* (2013.01)

(58) Field of Classification Search
CPC ..... C21D 8/0405; C21D 8/0463; C21D 8/12; C21D 8/1222; C21D 8/1233; C21D 8/1261; C21D 8/1266; C21D 8/1272; C21D 9/46; C21D 9/48; C22C 38/001; C22C 38/004; C22C 38/008; C22C 38/02; C22C 38/04; C22C 38/34; C22C 38/38; C22C 38/58; C22C 38/60
See application file for complete search history.

(56) References Cited

U.S. PATENT DOCUMENTS

| | | | | |
|---|---|---|---|---|
| 10,102,951 | B2 | 10/2018 | Oda et al. | |
| 2006/0124207 | A1* | 6/2006 | Takashima | H01F 1/16 148/546 |
| 2006/0243351 | A1 | 11/2006 | Ohashi et al. | |
| 2013/0263981 | A1 | 10/2013 | Zaizen et al. | |
| 2015/0170812 | A1 | 6/2015 | Murakami et al. | |
| 2016/0042850 | A1 | 2/2016 | Oda et al. | |
| 2016/0351308 | A1 | 12/2016 | Oda et al. | |
| 2018/0066333 | A1 | 3/2018 | Nakajima et al. | |

FOREIGN PATENT DOCUMENTS

| | | | | |
|---|---|---|---|---|
| CN | 103270179 | A | 8/2013 | |
| CN | 103687966 | A | 3/2014 | |
| CN | 103882296 | A | 6/2014 | |
| CN | 104532119 | A | 4/2015 | |
| CN | 105189799 | A | 12/2015 | |
| CN | 105829566 | A | 8/2016 | |
| EP | 2657355 | A1 | 10/2013 | |
| EP | 3095887 | A1 | 11/2016 | |
| JP | H0686624 | B2 * | 11/1994 | C21D 8/1222 |
| JP | H10110218 | A | 4/1998 | |
| JP | 2002356752 | A | 12/2002 | |
| JP | 3490048 | B2 | 1/2004 | |
| JP | 4218136 | B2 | 2/2009 | |
| JP | 2013112853 | A | 6/2013 | |
| JP | 2014198896 | A | 10/2014 | |
| JP | 2016125134 | A | 7/2016 | |
| JP | 2016151050 | A | 8/2016 | |
| JP | 2017193731 | A | 10/2017 | |
| KR | 1020040057215 | A | 7/2004 | |
| TW | 201632639 | A | 9/2016 | |
| WO | 2013137092 | A1 | 9/2013 | |
| WO | WO-2014142100 | A1 * | 9/2014 | C22C 38/02 |
| WO | WO-2015107967 | A1 * | 7/2015 | C22C 38/001 |
| WO | 2016017263 | A1 | 2/2016 | |
| WO | 2016027445 | A1 | 2/2016 | |

OTHER PUBLICATIONS

Apr. 23, 2018, Office Action issued by the Taiwan Intellectual Property Office in the corresponding Taiwanese Patent Application No. 106140406 with English language Search Report.
Sep. 19, 2019, the Extended European Search Report issued by the European Patent Office in the corresponding European Patent Application No. 17873044.6.
Jul. 20, 2020, Office Action issued by the China National Intellectual Property Administration in the corresponding Chinese Patent Application No. 201780071410.7 with English language search report.
Apr. 6, 2021, Office Action issued by the China National Intellectual Property Administration in the corresponding Chinese Patent Application No. 201780071410.7 with English language concise statement of relevance.

* cited by examiner

NON-ORIENTED ELECTRICAL STEEL SHEET AND MANUFACTURING METHOD THEREFOR

TECHNICAL FIELD

This disclosure relates to a non-oriented electrical steel sheet and a manufacturing method therefor.

BACKGROUND

Non-oriented electrical steel sheets are a type of soft magnetic material widely used as, for example, iron core materials for motors. In recent years, high efficiency of electrical equipment has been strongly demanded in the worldwide trends for power saving and global environment protection. Therefore, even in non-oriented electrical steel sheets widely used as iron core materials for rotary machines or medium/small-sized transformers, the demand for improvement in magnetic properties has further increased. Particularly, the tendency is remarkable in motors for electric vehicles or compressors where the efficiency of rotary machines is advanced. In order to meet the above requirements, attempts have been made to lower the iron loss by adding alloying elements such as Si and Al, decreasing the sheet thickness, controlling the surface condition, improving the grain growth property through control of precipitates, and so on.

For example, JP34190048B (PTL 1) describes that by adding 1.0% or more of Si and 0.7% or more of Al and by controlling the surface roughness of the steel sheet after cold rolling and the partial pressure ratio of hydrogen and water vapor in the atmosphere of final annealing, an Al oxide layer on the surface layer of a steel sheet is reduced, and the iron loss decreases.

On the other hand, recently, from the viewpoint of motor recycling, there is a movement to melt the used motor core and to reuse it as a cast frame in a motor frame or the like. Since the electrical steel sheet described in PTL 1 contains Al, when it is recycled, the viscosity of the molten steel at the time of casting increases, causing undesirable shrinkage cavities. Therefore, when recycling motor cores as pig iron for castings, it is preferable that Al is substantially not added.

JP4218136B (PTL describes a technique concerning a method for manufacturing a non-oriented electrical steel sheet substantially free of Al and excellent in iron loss properties. With this technique, by adding 0.01% to 1% of Si and 1.5% or less of Mn and by appropriately adjusting the amount of dissolved oxygen in the preliminary deoxidation, $SiO_2$—MnO—$Al_2O_3$ inclusions are rendered non-ductile, and the grain growth property during final annealing is improved. The added amounts of Si and Mn applied in this technique are relatively small, and it is desired to increase the content of Si and/or Mn to further reduce the iron loss.

CITATION LIST

Patent Literature

PTL 1: JP3490048B
PTL 2: JP4218136B

SUMMARY

Technical Problem

It would thus helpful to provide a non-oriented electrical steel sheet with low iron loss that is substantially free of Al and contains large amounts of Si and Mn, and a method for manufacturing the same in an easy way.

Solution to Problem

The inventors made intensive studies to solve the problems stated above. As a result, it was found that a steel free of Al and containing large amounts of Si and Mn can lower the coiling temperature after the hot rolling and suppress the precipitation of Si—Mn nitrides, thereby improving the grain growth property during final annealing and reducing the iron loss. Based on this, the present disclosure was completed.

First, experiments leading to the development of the present disclosure will be described.

<Experiment 1>

In order to develop a non-oriented electrical steel sheet excellent in iron loss properties, the inventors focused attention on the effect of reducing iron loss due to an increase in the amount of Mn, and investigated the influence of Mn on iron loss. Unless otherwise specified, "%" indicates "mass %" as used herein for the chemical composition described below.

Using steels containing C: 0.002%, Si: 2.0%, P: 0.01%, S: 0.002%, Al: 0.001%, and N: 0.0015% as base materials, steel ingots were prepared by varying the Mn contents in the range of 0.5% to 3.0%, and the resulting steel ingots were used as samples. These samples were hot rolled to obtain hot-rolled sheets having a thickness of 2.0 mm. At that time, cooling after the hot rolling was performed with the average cooling rate in a temperature range from 800° C. to 650° C. set at 35° C./s. Then, after coiling treatment was performed at a temperature of 650° C., hot band annealing was carried out at 1000° C. for 10 s. The average cooling rate in a temperature range from 800° C. to 650° C. after the hot band annealing was set at 35° C./s. Thereafter, each hot-rolled sheet was cold rolled to obtain a cold-rolled sheet having a thickness of 0.25 mm. Lastly, final annealing was performed at 1000° C. for 10 s in an atmosphere of 20 vol % $H_2$-80 vol % $N_2$. Iron loss $W_{15/50}$ of each steel sheet thus obtained was measured with a 25-cm Epstein device.

FIG. 1 illustrates the relationship between the Mn content and the iron loss $W_{15/50}$. When the Mn content is less than 1.0%, the same result as the conventional finding was obtained that the iron loss decreases as the Mn content increases. However; it was newly found that when the Mn content is 1.0% or more, the decrease in iron loss accompanying the increase in Mn content becomes so small that the iron loss hardly decreases without following the descending degree of iron loss (as indicated by the chain line in the figure) at a Mn content of less than 1.0%. In order to investigate this cause, the microstructure of the cross section of each steel sheet after the final annealing was observed under an optical microscope. As a result, it was found that steel sheets with Mn content of 1.0% or more have a smaller grain size. In addition, observation of precipitates of each steel sheet under a transmission electron microscope (TEM) using the extraction replica method revealed that steel sheets with Mn content of 1.0% or more contained a large number of fine Si—Mn nitrides. As used herein, "Si—Mn nitrides" refers to precipitates such that the sum of the proportions of Si and Mn is 10% or more and the proportion of N is 5% or more in terms of atomic ratio obtained by Energy dispersive X-ray spectrometry (EDS).

Regarding the results of observing precipitates, FIG. 2 illustrates the relationship between the Mn content and the number density of Si—Mn nitrides having an average diameter of 50 nm to 500 nm. It was found that in the case where the Mn content is 1.0% or more, the number density of Si—Mn nitrides exceeds $1/\mu m^3$. From this, it is considered that the reason for the increase in the iron loss is attributable to the increase in hysteresis loss due to the deterioration in the grain growth property accompanying the increase in the number density of Si—Mn nitrides.

<Experiment 2>

In order to lower the number density of Si—Mn nitrides of each high-Mn steel, the influence of the coiling temperature of hot-rolled sheets on the iron loss was investigated subsequently. Specifically, steel ingots containing C: 0.002%, Si: 2.0%, Mn: 2.0%, P: 0.02%, S: 0.002%, Al 0.001%, and N: 0.0015% were prepared and used as samples. These samples were hot rolled to obtain hot-rolled sheets having a thickness of 2.0 mm. At that time, cooling after the hot rolling was performed with the average cooling rate in a temperature range from 800° C. to 650° C. set at 35° C./s. Then, after coiling treatment was performed at a temperature of 500° C. to 700° C., hot band annealing was carried out at 1000° C. for 10 s. The average cooling rate in a temperature range from 800° C. to 650° C. after the hot band annealing was set at 35° C./s. Thereafter, each hot-rolled sheet was cold rolled to obtain a cold-rolled sheet having a thickness of 0.25 mm. Lastly, final annealing was performed at 1000° C. for 10 s in an atmosphere of 2.0 vol % $H_2$-80 vol % $N_2$. Iron loss $W_{15/50}$ of each steel sheet thus obtained was measured with a 25-cm Epstein device.

FIG. 3 illustrates the relationship between the coiling temperature of hot-rolled sheets and the iron loss $W_{15/50}$. As can be seen from FIG. 3, it was found that when the coiling temperature was set at 650° C. or lower, the iron loss decreased. In order to investigate this cause, the cross-sectional microstructure of each steel sheet after the final annealing was observed under an optical microscope. As a result, it was found that when the coiling temperature is set at 650° C. or lower, the grain size increases.

Therefore, precipitates of the final-annealed sheet were observed under the TEM using the extraction replica method. FIG. 4 illustrates the relationship between the coiling temperature of the hot-rolled sheet and the number density of Si—Mn nitrides having an average diameter of 50 nm to 500 nm. It can be seen from the figure that when the coiling temperature is set at 650° C. or lower, the number density of Si—Mn nitrides is lowered to $1/\mu m^3$ or less. As described above, when the coiling temperature is set at 650° C. or lower, precipitation of Si—Mn nitrides during the coiling process is suppressed even when the Mn content is 1.0% or more, and the grain growth property during final annealing can be improved. Although the reason why the precipitation of Si—Mn nitrides is suppressed when the coiling temperature is set at 650° C. or lower is unclear, yet it is considered to be that as a result of lowering the coiling temperature, Si and Mn did not sufficiently diffuse and precipitation of Si—Mn nitrides did not occur.

From these results, it was found that for a steel substantially free of Al and containing large amounts of Si and Mn, precipitation of Si—Mn nitrides is suppressed and the iron loss is reduced by controlling the coiling temperature after the hot rolling under appropriate conditions. The present disclosure was completed based on these discoveries.

Specifically, primary features of the present disclosure are as follows.

1. A non-oriented electrical steel sheet comprising a chemical composition containing (consisting of), by mass %, C: 0.0050%, or less, Si: 2.0% to 6.0%, Mn: 1.0% to 3.0%, P: 0.20% or less, S: 0.0050% or less, N: 0.0050% or less, and Al: 0.0050% or less, with the balance being Fe and inevitable impurities, wherein Si—Mn nitrides having an average diameter of 50 nm to 500 nm has a number density of $1/\mu m^3$ or less.

2. The non-oriented electrical steel sheet according to 1., wherein the chemical composition further contains, by mass %, at least one selected from the group consisting of Sn: 0.01% to 0.50% and Sb: 0.01% to 0.50%.

3. The non-oriented electrical steel sheet according to 1. or 2., wherein the chemical composition further contains, by mass %, at least one selected from the group consisting of Ca: 0.0001% to 0.0300% Mg: 0.0001% to 0.0300% and, REM: 0.0001% to 0.0300%.

4. The non-oriented electrical steel sheet according to any one of 1. to 3., wherein the chemical composition further contains, by mass %, at least one selected from the group consisting of Ni: 0.01% to 5.00% and Co: 0.01% to 5.00%.

5, A method for manufacturing a non-oriented electrical steel sheet, comprising: hot rolling a slab having the chemical composition as recited in any one of 1. to 4. to obtain a hot-rolled sheet; coiling the hot-rolled sheet into a coil; cold rolling the hot-rolled sheet once, or twice with intermediate annealing therebetween, to obtain a cold-rolled sheet; and subjecting the cold-rolled sheet to final annealing, wherein the hot-rolled sheet after subjection to the hot rolling is subjected to cooling at an average cooling rate of 30° C./s or higher in a temperature range from 800° C. to 650° C., and then the coiling is performed at 650° C. or lower.

6. A method for manufacturing a non-oriented electrical steel sheet, comprising: hot rolling a slab having the chemical composition as recited in any one of 1. to 4. to obtain a hot-rolled sheet; coiling the hot-rolled sheet into a coil; subjecting the hot-rolled sheet to hot band annealing and subsequently cold rolling the hot-rolled sheet once, or twice with intermediate annealing therebetween, to obtain a cold-rolled sheet; and subjecting the cold-rolled sheet to final annealing; wherein the hot-rolled sheet after subjection to the hot rolling is subjected to cooling at an average cooling rate of 30° C./s or higher in a temperature range from 800° C. to 650° C., and then the coiling is performed at 650° C. or lower, and the hot-rolled sheet after subjection to the hot band annealing is subjected to cooling at an average cooling rate of 30° C./s or higher in a temperature range from 800° C. to 650° C.

Advantageous Effect

According to the present disclosure, it is possible to provide a non-oriented electrical steel sheet in which low iron loss properties can be obtained by increasing the contents of Si and Mn while substantially not adding Al.

DETAILED DESCRIPTION

Figure 1:
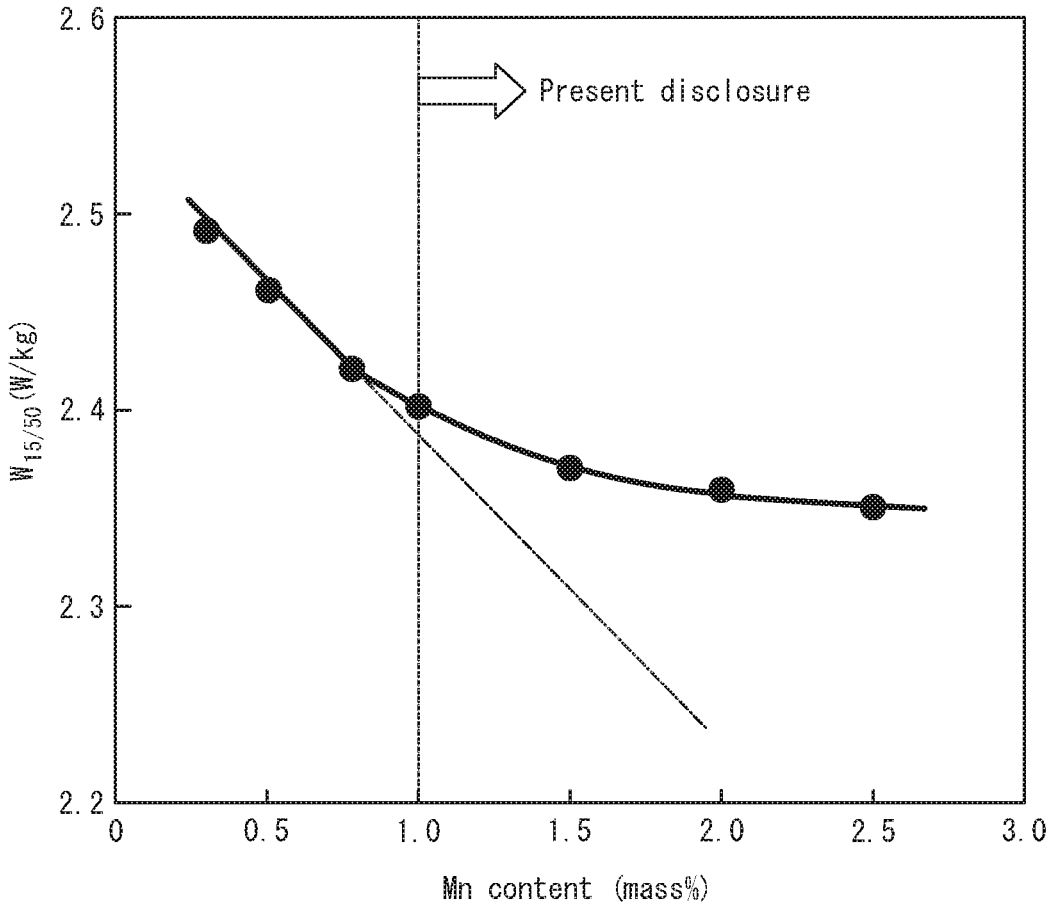
FIG. 1 is a graph illustrating the relationship between the Mn content and the iron loss $W_{15/50}$.
Figure 2:
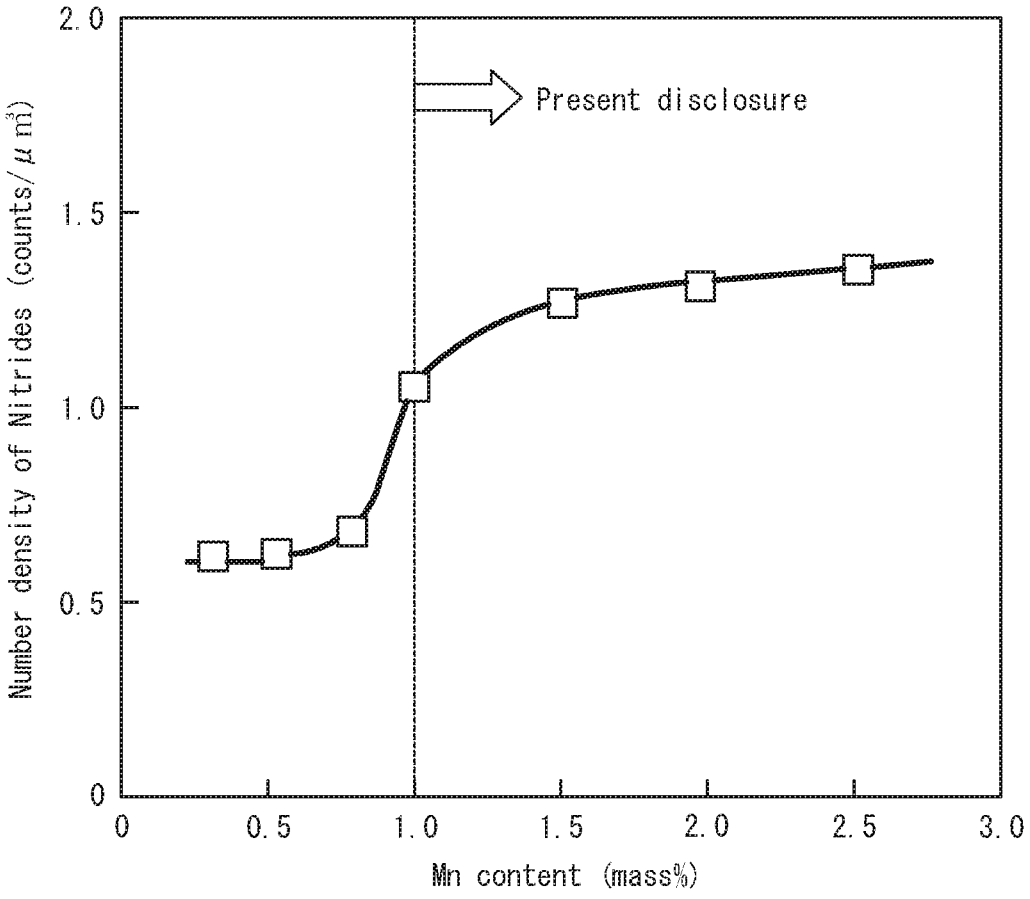
FIG. 2 is a graph illustrating the relationship between the Mn content and the number density of Si—Mn nitrides having an average diameter of 50 nm to 500 nm.
Figure 3:
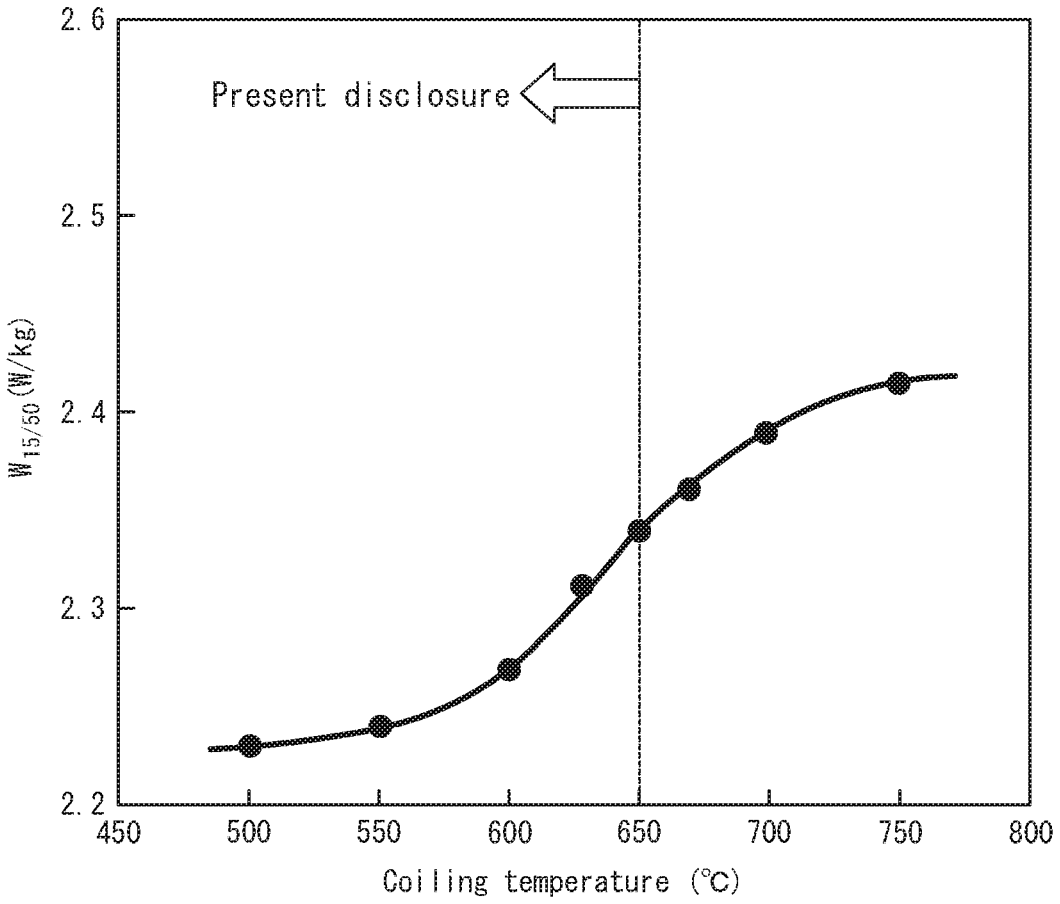
FIG. 3 is a graph illustrating the relationship between the coiling temperature of hot-rolled sheets and the iron loss $W_{15/50}$.
Figure 4:
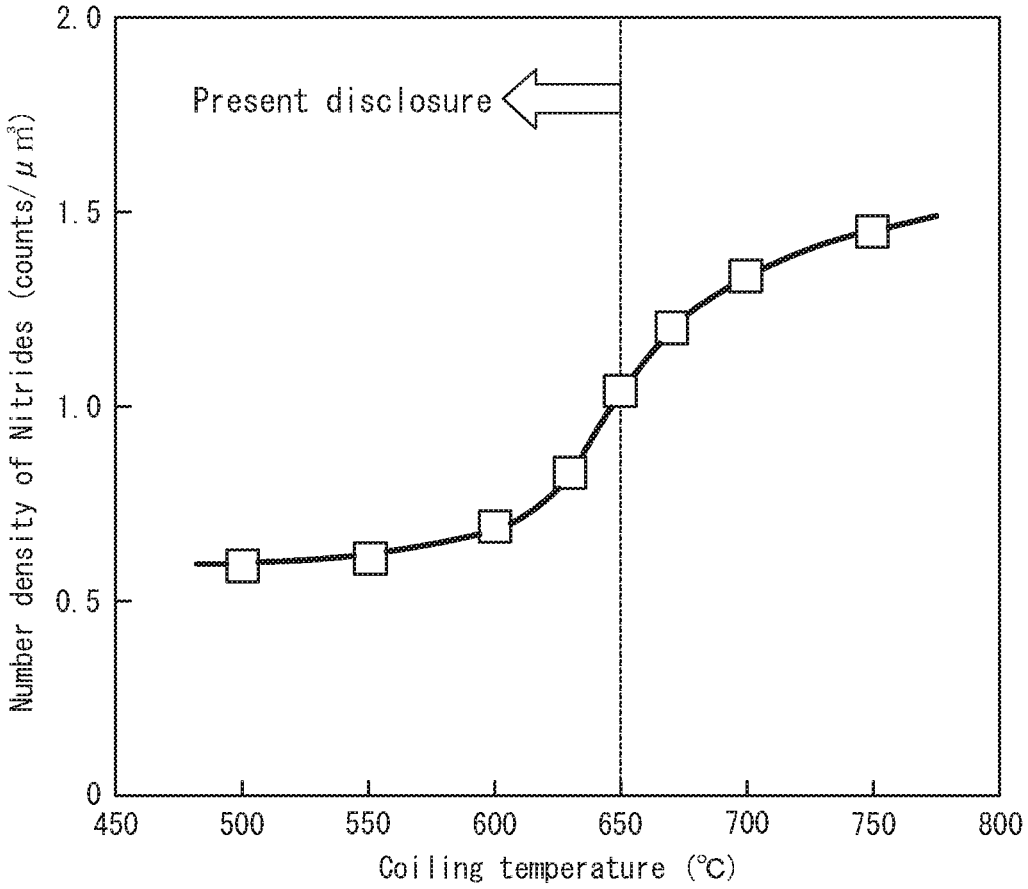
FIG. 4 is a graph illustrating the relationship between the coiling temperature of hot-rolled sheets and the number density of Si—Mn nitrides having an average diameter of 50 nm to 500 nm.

Next, the chemical composition of a non-oriented electrical steel sheet according to the present disclosure will be described.

C: 0.0050% or Less

Since C may cause magnetic aging in the product sheet, the C content is limited to 0.0050% or less. The C content is preferably 0.0040% or less. On the other hand, the C content is preferably 0.0005% or more from the cost perspective since reducing it below 0.0005% requires a high manufacturing cost.

Si: 2.0% to 6.0%

Si is an effective element for reducing the iron loss by increasing the specific resistance of steel, and is thus intentionally added at 2.0% or more. However, excessive addition leads to conspicuous embrittlement, making cold rolling difficult. Therefore, the upper limit is set at 6.0%. The Si content is preferably in the range of 2.5% to 4.0%.

Mn: 1.0% to 3.0%

Mn is an effective element for reducing the iron loss by increasing the specific resistance of steel, and is thus intentionally added in excess of 1.0%. However, excessive addition beyond 3.0% leads to deterioration of the cold rolling manufacturability and a decrease in the magnetic flux density. Therefore, the upper limit is set at 3.0%. The Mn content is preferably in the range of 1.0% to 2.0%. It is more preferably 1.2% or more, and even more preferably 1.4% or more.

P: 0.20% or Less

P is an element that is excellent in solid solution strengthening ability and is thus effective for adjusting hardness and improving blanking workability. Since excessive addition beyond 0.20% causes conspicuous embrittlement, the upper limit is set at 0.20%. The P content is preferably 0.050% or less. On the other hand, the P content is preferably 0.0005% or more from the cost perspective since reducing it below 0.0005% requires a high manufacturing cost.

S: 0.0050% or Less

Since S is a harmful element which generates sulfides and increases iron loss, the upper limit is set at 0.0050%. The S content is preferably 0.0040% or less. On the other hand, the S content is preferably 0.0001% or more from the cost perspective since reducing it below 0.0001% requires a high manufacturing cost.

N: 0.0050% or Less

Since N is a harmful element which generates Si—Mn nitrides as described above and increases iron loss, the upper limit is set at 0.0050%. The N content is preferably 0.0030% or less, and more preferably 0.0015% or less. On the other hand, the N content is preferably 0.0001% or more from the cost perspective since reducing it below 0.0001% requires a high manufacturing cost.

Al: 0.0050% or Less

From the viewpoint of recycling, it is desirable that substantially no Al be added. When Al is present in a trace amount, fine AlN particles are formed to inhibit grain growth and harm the magnetic properties. Therefore, the upper limit is set at 0.0050%. The Al content is preferably 0.0030% or less. As used herein, "substantially no Al be added" means that Al may be present within a range allowing inclusion of inevitable components, including the case where the Al content is zero.

Sn and Sb: 0.01% to 0.50%

Sn and Sb are elements which improve the texture, and are thus effective for improving the magnetic flux density. Any of these elements has no such effect unless added in an amount of 0.01 or more. However, if added beyond 0.50%, the above effect reaches a plateau. Therefore, the content of each added element is in the range of 0.01% to 0.50%. It is preferably in the range of 0.03% to 0.50%.

Ca, Mg, REM: 0.0001% to 0.0300%

Ca, Mg, and REM are effective elements for reducing iron loss since they fix S and suppress fine precipitation of sulfides. Any of these elements has no such effect unless added in an amount of 0.0001% or more. However, if added beyond 0.0300 the above effect reaches a plateau. Therefore, the content of each added element is in the range of 0.0001% to 0.0300%, The content of each added element is preferably in the range of 0.0020% to 0.0300%.

Ni and Co: 0.01% to 5.00%

Ni and Co are effective elements for reducing the iron loss by increasing the specific resistance of steel. Any of these elements has no such effect unless added in an amount of 0.01% or more. However, if added beyond 5.00%, the alloy cost increases. Therefore, the content of each added element is in the range of 0.01% to 5.00%. The content of each added element is preferably in the range of 0.05% to 5.00%.

In the non-oriented electrical steel sheet according to the disclosure, the balance other than the above components is Fe and inevitable impurities. However, the present disclosure is not intended to exclude other components that are not described herein, without losing the advantages of the present disclosure.

In the present disclosure, the number density of Si—Mn nitrides having an average diameter of 50 nm to 500 nm in the steel sheet is limited to $1/\mu m^3$ or less. If the number density exceeds $1/\mu m^3$, the iron loss of the final-annealed steel sheet does not decrease sufficiently. The number density is preferably $0.8/\mu m^3$ or less, and more preferably $0.7/\mu m^3$ or less. In this case, Si—Mn nitrides are observed under the TEM using the extraction replica method. At that time, measurement is carried out within a field of view to such an extent that the diameter and the number of Si—Mn nitrides are not biased. Specifically, it is preferable to observe a range of 1000 $\mu m^2$ in a field at ×10,000 magnification or higher. This observation is targeted at Si—Mn nitrides having a diameter of 50 nm to 500 nm, which have a large effect on the domain wall displacement, and for those not isotropic in shape, the result of averaging the major axis length and the minor axis length is defined as its diameter. The number density of Si—Mn nitrides is calculated assuming that the total electric charge flowing through the surface of the sample in the electrolytic process during the replica production process is consumed for electrolysis to divalent ions of Fe, and that all precipitates remaining as residue at the time of electrolysis are captured on the replica. In our usual replica production, electrolysis is carried out at the quantity of electricity of 3 $C/cm^2$ on the sample surface area, and precipitates within the thickness of about 1.1 μm from the sample surface are observed on the replica.

Next, a method for manufacturing the non-oriented electrical steel sheet according to the disclosure will be described.

The non-oriented electrical steel sheet disclosed herein may be manufactured by a known method as long as a steel material having the above-mentioned chemical composition is used as the base material and the cooling conditions and the coiling temperature after the hot rolling are within the specified ranges. For example, the method may include: smelting a steel adjusted to the above-mentioned predetermined chemical composition through refining in a converter, an electric furnace; or the like; subjecting the steel to secondary refining in a degassing facility or the like; subjecting the steel to continuous casting to form a steel slab; then hot rolling the steel slab to obtain a hot-rolled sheet; optionally subjecting the sheet to hot band annealing; subjecting the sheet to pickling; cold rolling the sheet; subjecting the sheet to final annealing; and subjecting the sheet to stress relief annealing.

The hot-rolled sheet subjected to the hot rolling preferably has a thickness of 1.0 mm to 5.0 mm. The reason is that if the thickness is less than 1.0 mm, rolling troubles increase during the hot rolling; while if it exceeds 5.0 mm, the cold rolling reduction in the subsequent step becomes too high and the texture deteriorates.

Here, in cooling after the hot rolling, it is important to set the average cooling rate in a temperature range from 800° C. to 650° C. to 30° C./s or higher. The reason is that when the average cooling rate is lower than 30° C./s, a large amount of Si—Mn nitrides is precipitated during cooling after the hot rolling, and the iron loss increases. On the other hand, from the viewpoint of suppressing deformation due to cooling strain, it is preferable to set the average cooling rate in a temperature range from 800° C. to 650° C. to 300° C./s or lower.

In order to increase the average cooling rate after the hot rolling, for example, there is a method of spraying cooling water having a water temperature of 30° C. or lower on a steel sheet on a run-out table after the hot rolling. In order to further increase the cooling rate, it is preferable that the nozzles of the cooling water are alternately arranged in different directions so as not to form a water layer on the steel sheet.

The hot-rolled sheet subjected to the above-mentioned cooling is coiled into a coil, where the coiling temperature needs to be 650° C. or lower, more preferably 600° C. or lower, and even more preferably 550° C. or lower. This is because precipitation of Si—Mn nitrides decreases as the coiling temperature decreases, and precipitation is hardly observed particularly at 550° C. or lower. On the other hand, when the temperature is lower than 300° C., the amount of precipitated nitrides no longer changes and the plant capacity may be excessive. Therefore, the coiling temperature is preferably set to 300° C. or higher.

The hot-rolled sheet may optionally be subjected to hot band annealing. However, the effect of the present disclosure is noticeable without hot band annealing. This is because if hot band annealing is performed, Si—Mn nitrides tend to precipitate during cooling after the hot band annealing.

In the case of performing hot band annealing, the soaking temperature is preferably set in the range of 900° C. to 1200° C. That is, if the soaking temperature is lower than 900° C., the effect of hot band annealing can not be sufficiently obtained and the magnetic properties are not improved, whereas if it exceeds 1200° C., scale-induced surface defects may occur. After the hot band annealing, as described above, in order to suppress precipitation of Si—Mn nitrides, cooling is performed at a cooling rate of 30° C./s or higher in a temperature range from 800° C. to 650° C.

Then, the hot-rolled sheet or hot-band-annealed sheet is preferably cold rolled once, or twice or more with intermediate annealing therebetween. In particular, in the final cold rolling, warm rolling in which the steel sheet is rolled at a sheet temperature of about 200° C. is particularly effective to improve the magnetic flux density, and it is thus preferable to perform warm rolling as long as there is no problem in terms of cost and plant and production constraints.

The thickness of the cold-rolled sheet (final sheet thickness) is preferably set in the range of 0.1 mm to 0.5 mm. The reason is that if the thickness is less than 0.1 mm, productivity decreases, whereas if it is more than 0.5 mm, the iron loss reducing effect is small.

In final annealing applied to the cold-rolled sheet having the final sheet thickness, the cold-rolled sheet is preferably soaked in a continuous annealing furnace at a temperature of 700° C. to 1200° C. for 1 second to 300 seconds. When the soaking temperature is lower than 700° C., recrystallization does not proceed sufficiently and good magnetic properties can not be obtained, and furthermore, the shape adjusting effect can not be obtained sufficiently during continuous annealing. On the other hand, when the soaking temperature is above 1200° C., the grain size increases and the toughness is lowered. Also, if the soaking time is shorter than 1 second, it is difficult to control the grain size, whereas if it exceeds 300 seconds, the productivity decreases.

Subsequently, in order to increase the interlaminar resistance and reduce the iron loss, it is preferable to form an insulating coating on a surface of the steel sheet after the final annealing. In particular, when it is desired to ensure good blanking properties, it is desirable to apply a semi-organic insulating coating containing a resin.

The non-oriented electrical steel sheet on which an insulating coating is formed may be used after being subjected to stress relief annealing at the user's end, or may be used as it is without being subjected to stress relief annealing. The stress relief annealing may also be performed after blanking processing is performed at the user's end. The stress relief annealing is generally carried out at about 750° C. for about 2 hours.

EXAMPLES

Example 1

Steel Nos. 1 to 51 having the chemical compositions listed in Table 1 were smelted through a refining process in converter-vacuum degassing treatment, formed into slabs by continuous casting, and the slabs were heated at 1140° C. for 1 hour, hot rolled to a thickness of 2.0 mm, and subjected to cooling after the hot rolling, and subjected to coiling under the conditions listed in Table 2. Subsequently, each hot-rolled sheet is subjected to hot band annealing at 1000° C. for 30 seconds, followed by pickling, and then cold rolled to a thickness of 0.25 mm. The average cooling rate in a temperature range from 800° C. to 650° C. after the hot band annealing was set to 32° C./s. Then, each steel sheet was subjected to final annealing at 1000° C. for 10 seconds in an atmosphere of 20 vol % $H_2$-80 vol % $N_2$, and an insulating coating was applied to the steel sheet to obtain a non-oriented electrical steel sheet. Finally, the iron loss $W_{15/50}$ was evaluated with a 25-cm Epstein device using 30 mm 280 mm Epstein test pieces, and the number density of Si—Mn nitrides of each final-annealed sheet was measured under the TEM using the extraction replica method. The results thereof are listed in Table 2. The number density of Si—Mn nitrides was calculated from the number of Si—Mn nitrides that were present when observing a range of 1000 $\mu m^2$ in a field at ×10,000 magnification.

It can be seen from Table 2 that by controlling the chemical composition of the steel material and the coiling treatment conditions within the ranges as specified in the present disclosure, it is possible to easily obtain non-oriented electrical steel sheets having excellent iron loss properties.

TABLE 1

(mass %)

| Condition No. | C | Si | Mn | P | S | N | Al | Sn | Sb | Ca | Mg | REM | Ni | Co |
|---|---|---|---|---|---|---|---|---|---|---|---|---|---|---|
| 1 | 0.0016 | 2.51 | 1.51 | 0.011 | 0.0024 | 0.0011 | 0.0010 | tr. | tr. | tr. | tr. | tr. | tr. | tr. |
| 2 | 0.0019 | 3.00 | 1.50 | 0.010 | 0.0020 | 0.0014 | 0.0010 | tr. | tr. | tr. | tr. | tr. | tr. | tr. |
| 3 | 0.0017 | 4.03 | 1.53 | 0.010 | 0.0023 | 0.0014 | 0.0007 | tr. | tr. | tr. | tr. | tr. | tr. | tr. |
| 4 | 0.0020 | 5.04 | 1.51 | 0.008 | 0.0023 | 0.0015 | 0.0008 | tr. | tr. | tr. | tr. | tr. | tr. | tr. |
| 5 | 0.0018 | 6.50 | 1.06 | 0.008 | 0.0020 | 0.0014 | 0.0007 | tr. | tr. | tr. | tr. | tr. | tr. | tr. |
| 6 | 0.0020 | 2.54 | 0.89 | 0.008 | 0.0030 | 0.0025 | 0.0008 | tr. | tr. | tr. | tr. | tr. | tr. | tr. |
| 7 | 0.0020 | 2.55 | 1.06 | 0.008 | 0.0030 | 0.0015 | 0.0008 | tr. | tr. | tr. | tr. | tr. | tr. | tr. |
| 8 | 0.0019 | 2.51 | 1.96 | 0.012 | 0.0022 | 0.0014 | 0.0010 | tr. | tr. | tr. | tr. | tr. | tr. | tr. |
| 9 | 0.0018 | 2.51 | 2.93 | 0.011 | 0.0022 | 0.0015 | 0.0009 | tr. | tr. | tr. | tr. | tr. | tr. | tr. |
| 10 | 0.0017 | 2.52 | 3.25 | 0.011 | 0.0021 | 0.0018 | 0.0009 | tr. | tr. | tr. | tr. | tr. | tr. | tr. |
| 11 | 0.0015 | 2.50 | 1.05 | 0.011 | 0.0018 | 0.0017 | 0.0007 | tr. | tr. | tr. | tr. | tr. | tr. | tr. |
| 12 | 0.0017 | 2.50 | 1.05 | 0.011 | 0.0017 | 0.0015 | 0.0007 | tr. | tr. | tr. | tr. | tr. | tr. | tr. |
| 13 | 0.0016 | 2.50 | 1.05 | 0.011 | 0.0016 | 0.0016 | 0.0007 | tr. | tr. | tr. | tr. | tr. | tr. | tr. |
| 14 | 0.0020 | 2.46 | 1.54 | 0.011 | 0.0025 | 0.0010 | 0.0007 | tr. | tr. | tr. | tr. | tr. | tr. | tr. |
| 15 | 0.0015 | 2.53 | 1.50 | 0.012 | 0.0022 | 0.0014 | 0.0006 | tr. | tr. | tr. | tr. | tr. | tr. | tr. |
| 16 | 0.0021 | 2.54 | 1.47 | 0.012 | 0.0028 | 0.0012 | 0.0008 | tr. | tr. | tr. | tr. | tr. | tr. | tr. |
| 17 | 0.0008 | 2.46 | 1.51 | 0.011 | 0.0028 | 0.0013 | 0.0006 | tr. | tr. | tr. | tr. | tr. | tr. | tr. |
| 18 | 0.0044 | 2.47 | 1.55 | 0.012 | 0.0022 | 0.0014 | 0.0009 | tr. | tr. | tr. | tr. | tr. | tr. | tr. |
| 19 | 0.0060 | 2.48 | 1.56 | 0.012 | 0.0023 | 0.0012 | 0.0009 | tr. | tr. | tr. | tr. | tr. | tr. | tr. |
| 20 | 0.0021 | 2.53 | 1.51 | 0.080 | 0.0024 | 0.0013 | 0.0008 | tr. | tr. | tr. | tr. | tr. | tr. | tr. |
| 21 | 0.0019 | 2.52 | 1.50 | 0.162 | 0.0025 | 0.0014 | 0.0008 | tr. | tr. | tr. | tr. | tr. | tr. | tr. |
| 22 | 0.0017 | 2.52 | 1.52 | 0.225 | 0.0021 | 0.0015 | 0.0007 | tr. | tr. | tr. | tr. | tr. | tr. | tr. |
| 23 | 0.0020 | 2.52 | 1.48 | 0.009 | 0.0008 | 0.0012 | 0.0009 | tr. | tr. | tr. | tr. | tr. | tr. | tr. |
| 24 | 0.0025 | 2.53 | 1.52 | 0.011 | 0.0045 | 0.0011 | 0.0009 | tr. | tr. | tr. | tr. | tr. | tr. | tr. |
| 25 | 0.0021 | 2.54 | 1.50 | 0.011 | 0.0060 | 0.0013 | 0.0009 | tr. | tr. | tr. | tr. | tr. | tr. | tr. |
| 26 | 0.0024 | 2.54 | 1.50 | 0.008 | 0.0030 | 0.0006 | 0.0008 | tr. | tr. | tr. | tr. | tr. | tr. | tr. |
| 27 | 0.0015 | 2.51 | 1.53 | 0.012 | 0.0029 | 0.0047 | 0.0009 | tr. | tr. | tr. | tr. | tr. | tr. | tr. |
| 28 | 0.0020 | 2.49 | 1.52 | 0.012 | 0.0022 | 0.0062 | 0.0009 | tr. | tr. | tr. | tr. | tr. | tr. | tr. |
| 29 | 0.0016 | 2.50 | 1.53 | 0.012 | 0.0026 | 0.0011 | 0.0045 | tr. | tr. | tr. | tr. | tr. | tr. | tr. |
| 30 | 0.0017 | 2.53 | 1.49 | 0.012 | 0.0020 | 0.0011 | 0.0072 | tr. | tr. | tr. | tr. | tr. | tr. | tr. |
| 31 | 0.0015 | 2.50 | 1.46 | 0.008 | 0.0020 | 0.0011 | 0.0007 | 0.005 | tr. | tr. | tr. | tr. | tr. | tr. |
| 32 | 0.0020 | 2.50 | 1.46 | 0.008 | 0.0021 | 0.0011 | 0.0007 | 0.03 | tr. | tr. | tr. | tr. | tr. | tr. |
| 33 | 0.0016 | 2.46 | 1.49 | 0.011 | 0.0030 | 0.0014 | 0.0007 | 0.13 | tr. | tr. | tr. | tr. | tr. | tr. |
| 34 | 0.0022 | 2.50 | 1.53 | 0.008 | 0.0028 | 0.0010 | 0.0010 | 0.47 | tr. | tr. | tr. | tr. | tr. | tr. |
| 35 | 0.0021 | 2.49 | 1.50 | 0.011 | 0.0023 | 0.0015 | 0.0007 | tr. | 0.005 | tr. | tr. | tr. | tr. | tr. |
| 36 | 0.0022 | 2.51 | 1.53 | 0.011 | 0.0026 | 0.0012 | 0.0007 | tr. | 0.04 | tr. | tr. | tr. | tr. | tr. |
| 37 | 0.0017 | 2.47 | 1.51 | 0.009 | 0.0027 | 0.0014 | 0.0009 | 0.03 | 0.03 | tr. | tr. | tr. | tr. | tr. |
| 38 | 0.0021 | 2.46 | 1.50 | 0.011 | 0.0023 | 0.0014 | 0.0008 | tr. | tr. | 0.0010 | tr. | tr. | tr. | tr. |
| 39 | 0.0022 | 2.46 | 1.51 | 0.011 | 0.0030 | 0.0013 | 0.0008 | tr. | tr. | 0.0031 | tr. | tr. | tr. | tr. |
| 40 | 0.0024 | 2.47 | 1.50 | 0.012 | 0.0021 | 0.0011 | 0.0010 | tr. | tr. | 0.0121 | tr. | tr. | tr. | tr. |
| 41 | 0.0016 | 2.49 | 1.54 | 0.012 | 0.0022 | 0.0014 | 0.0008 | tr. | tr. | tr. | 0.0029 | tr. | tr. | tr. |
| 42 | 0.0016 | 2.51 | 1.45 | 0.008 | 0.0025 | 0.0011 | 0.0007 | tr. | tr. | tr. | tr. | 0.0035 | tr. | tr. |
| 43 | 0.0020 | 2.47 | 1.46 | 0.010 | 0.0027 | 0.0011 | 0.0007 | tr. | tr. | 0.0033 | 0.0028 | 0.0033 | tr. | tr. |
| 44 | 0.0019 | 2.46 | 1.45 | 0.011 | 0.0020 | 0.0010 | 0.0007 | tr. | tr. | tr. | tr. | tr. | 0.005 | tr. |
| 45 | 0.0022 | 2.46 | 1.45 | 0.011 | 0.0029 | 0.0010 | 0.0007 | tr. | tr. | tr. | tr. | tr. | 0.05 | tr. |
| 46 | 0.0016 | 2.51 | 1.54 | 0.009 | 0.0022 | 0.0015 | 0.0007 | tr. | tr. | tr. | tr. | tr. | 2.05 | tr. |
| 47 | 0.0019 | 2.47 | 1.49 | 0.008 | 0.0022 | 0.0012 | 0.0008 | tr. | tr. | tr. | tr. | tr. | tr. | 0.005 |
| 48 | 0.0017 | 2.47 | 1.51 | 0.008 | 0.0029 | 0.0012 | 0.0008 | tr. | tr. | tr. | tr. | tr. | tr. | 0.05 |
| 49 | 0.0022 | 2.47 | 1.53 | 0.012 | 0.0022 | 0.0010 | 0.0007 | tr. | tr. | tr. | tr. | tr. | 0.05 | 0.05 |
| 50 | 0.0017 | 2.50 | 1.50 | 0.008 | 0.0021 | 0.0012 | 0.0009 | 0.03 | tr. | 0.0035 | tr. | tr. | 0.05 | tr. |
| 51 | 0.0018 | 1.80 | 1.47 | 0.009 | 0.0020 | 0.0011 | 0.0008 | tr. | tr. | tr. | tr. | tr. | tr. | tr. |

TABLE 2

| Condition No. | Cooling rate during hot rolling (° C./s) | Coiling temp. (° C.) | Number density of Si—Mn nitrides (coutns/μm$^3$) | $W_{15/50}$ (W/kg) | $B_{50}$ (T) | Remarks |
|---|---|---|---|---|---|---|
| 1 | 50 | 550 | 0.63 | 2.15 | 1.701 | Example |
| 2 | 50 | 550 | 0.61 | 2.09 | 1.682 | Example |
| 3 | 50 | 550 | 0.61 | 1.99 | 1.662 | Example |
| 4 | 50 | 550 | 0.63 | 1.88 | 1.663 | Example |
| 5 | 50 | 550 | — | — | — | Comparative Example (cracks occurred during cold rolling) |
| 6 | 50 | 550 | 0.63 | 2.29 | 1.715 | Comparative Example |
| 7 | 50 | 550 | 0.60 | 2.18 | 1.712 | Example |
| 8 | 50 | 550 | 0.60 | 2.12 | 1.690 | Example |
| 9 | 50 | 550 | 0.62 | 2.07 | 1.671 | Example |
| 10 | 50 | 550 | 0.62 | 2.35 | 1.652 | Comparative Example |
| 11 | 20 | 600 | 1.21 | 2.32 | 1.690 | Comparative Example |
| 12 | 35 | 600 | 0.66 | 2.20 | 1.700 | Example |
| 13 | 50 | 600 | 0.62 | 2.18 | 1.705 | Example |
| 14 | 50 | 600 | 0.68 | 2.19 | 1.703 | Example |

TABLE 2-continued

| Condition No. | Cooling rate during hot rolling (° C./s) | Coiling temp. (° C.) | Number density of Si—Mn nitrides (coutns/μm³) | $W_{15/50}$ (W/kg) | $B_{50}$ (T) | Remarks |
|---|---|---|---|---|---|---|
| 15 | 50 | 650 | 0.84 | 2.26 | 1.701 | Example |
| 16 | 50 | 700 | 1.25 | 2.30 | 1.697 | Comparative Example |
| 17 | 50 | 550 | 0.62 | 2.14 | 1.700 | Example |
| 18 | 50 | 550 | 0.63 | 2.19 | 1.701 | Example |
| 19 | 50 | 550 | 0 64 | 2.30 | 1.696 | Comparative Example |
| 20 | 50 | 550 | 0.63 | 2.15 | 1.702 | Example |
| 21 | 50 | 550 | 0.64 | 2.16 | 1.701 | Example |
| 22 | 50 | 550 | — | — | — | Comparative Example (cracks occurred during cold rolling) |
| 23 | 50 | 550 | 0.61 | 2.13 | 1.702 | Example |
| 24 | 50 | 550 | 0.63 | 2.21 | 1.702 | Example |
| 25 | 50 | 550 | 0.62 | 2.45 | 1.680 | Comparative Example |
| 26 | 50 | 550 | 0.50 | 2.08 | 1.701 | Example |
| 27 | 50 | 550 | 0.95 | 2.22 | 1.702 | Example |
| 28 | 50 | 550 | 1.12 | 2.41 | 1.685 | Comparative Example |
| 29 | 50 | 550 | 0.64 | 2.16 | 1.701 | Example |
| 30 | 50 | 550 | 0.59 | 2.72 | 1.672 | Comparative Example |
| 31 | 50 | 550 | 0.62 | 2.16 | 1.705 | Example |
| 32 | 50 | 550 | 0.62 | 2.15 | 1.715 | Example |
| 33 | 50 | 550 | 0.61 | 2.16 | 1.723 | Example |
| 34 | 50 | 550 | 0.61 | 2.15 | 1.725 | Example |
| 35 | 50 | 550 | 0.63 | 2.15 | 1.706 | Example |
| 36 | 50 | 550 | 0.64 | 2.14 | 1.723 | Example |
| 37 | 50 | 550 | 0.61 | 2.16 | 1.723 | Example |
| 38 | 50 | 550 | 0 60 | 2.10 | 1.700 | Example |
| 39 | 50 | 550 | 0.60 | 2.09 | 1.703 | Example |
| 40 | 50 | 550 | 0.63 | 1.99 | 1.702 | Example |
| 41 | 50 | 550 | 0 62 | 2.08 | 1.701 | Example |
| 42 | 50 | 550 | 0.62 | 2.08 | 1.701 | Example |
| 43 | 50 | 550 | 0.61 | 2.04 | 1.702 | Example |
| 44 | 50 | 550 | 0.62 | 2.12 | 1.701 | Example |
| 45 | 50 | 550 | 0.62 | 2.12 | 1.705 | Example |
| 46 | 50 | 550 | 0.64 | 2.01 | 1.715 | Example |
| 47 | 50 | 550 | 0.63 | 2.13 | 1.705 | Example |
| 48 | 50 | 550 | 0.63 | 2.12 | 1.720 | Example |
| 49 | 50 | 550 | 0.64 | 2.10 | 1.702 | Example |
| 50 | 50 | 550 | 0.61 | 2.05 | 1.722 | Example |
| 51 | 50 | 550 | 0.59 | 2.53 | 1.713 | Comparative Example |

Example 2

Through a refining process in converter-vacuum degassing treatment, the slab Nos. 1 to 51 manufactured as listed in Table 1 were processed in the same manner as in Example 1 to obtain non-oriented electrical steel sheets except that hot band annealing was not performed. Finally, the iron loss $W_{15/50}$ was evaluated with a 25-cm Epstein device using 30 mm×280 mm Epstein test pieces, and the number density of Si—Mn nitrides of each final-annealed sheet was measured under the TEM using the same extraction replica method as in Example 1. The results thereof are listed in Table 3.

It can be seen from Table 3 that by controlling the chemical composition of the steel material and the coiling treatment conditions within the ranges as specified in the present disclosure, it is possible to easily obtain non-oriented electrical steel sheets having excellent iron loss properties.

TABLE 3

| Condition No. | Number density of Si—Mn nitrides (counts/μm³) | $W_{15/50}$ (W/kg) | $B_{50}$ (T) | Remarks |
|---|---|---|---|---|
| 1 | 0.60 | 2.16 | 1.682 | Example |
| 2 | 0.64 | 2.09 | 1.661 | Example |
| 3 | 0.63 | 2.00 | 1.643 | Example |
| 4 | 0.63 | 1.89 | 1.642 | Example |

TABLE 3-continued

| Condition No. | Number density of Si—Mn nitrides (counts/μm³) | $W_{15/50}$ (W/kg) | $B_{50}$ (T) | Remarks |
|---|---|---|---|---|
| 5 | — | — | — | Comparative Example (cracks occurred during cold rolling) |
| 6 | 0.62 | 2.17 | 1.693 | Example |
| 7 | 0.62 | 2.17 | 1.693 | Example |
| 8 | 0.63 | 2.12 | 1.670 | Example |
| 9 | 0.64 | 2.08 | 1.652 | Example |
| 10 | 0.65 | 2.41 | 1.632 | Comparative Example |
| 11 | 1.25 | 2.35 | 1.671 | Comparative Example |
| 12 | 0.68 | 2.22 | 1.681 | Example |
| 13 | 0.65 | 2.20 | 1.685 | Example |
| 14 | 0.68 | 2.18 | 1.683 | Example |
| 15 | 0.93 | 2.30 | 1.680 | Example |
| 16 | 1.42 | 2.41 | 1.678 | Comparative Example |
| 17 | 0.64 | 2.15 | 1.681 | Example |
| 18 | 0.63 | 2.20 | 1.680 | Example |
| 19 | 0.65 | 2.32 | 1.672 | Comparative Example |
| 20 | 0.61 | 2.16 | 1.682 | Example |
| 21 | 0.63 | 2.17 | 1.681 | Example |
| 22 | — | — | — | Comparative Example (cracks occurred during cold rolling) |
| 23 | 0.62 | 2.14 | 1.683 | Example |
| 24 | 0.60 | 2.22 | 1.681 | Example |
| 25 | 0.63 | 2.52 | 1.662 | Comparative Example |
| 26 | 0.51 | 2.08 | 1.682 | Example |
| 27 | 0.96 | 2.21 | 1.681 | Example |
| 28 | 1.16 | 2.45 | 1.662 | Comparative Example |
| 29 | 0.62 | 2.15 | 1.682 | Example |

TABLE 3-continued

| Condition No. | Number density of Si—Mn nitrides (counts/μm³) | $W_{15/50}$ (W/kg) | $B_{50}$ (T) | Remarks |
|---|---|---|---|---|
| 30 | 0.60 | 2.79 | 1.652 | Comparative Example |
| 31 | 0.60 | 2.14 | 1.687 | Example |
| 32 | 0.60 | 2.14 | 1.687 | Example |
| 33 | 0.61 | 2.16 | 1.702 | Example |
| 34 | 0.63 | 2.15 | 1.705 | Example |
| 35 | 0.62 | 2.15 | 1.701 | Example |
| 36 | 0.62 | 2.15 | 1.701 | Example |
| 37 | 0.60 | 2.15 | 1.703 | Example |
| 38 | 0.63 | 2.15 | 1.680 | Example |
| 39 | 0.63 | 2.10 | 1.682 | Example |
| 40 | 0.64 | 1.99 | 1.681 | Example |
| 41 | 0.64 | 2.08 | 1.682 | Example |
| 42 | 0.63 | 2.09 | 1.682 | Example |
| 43 | 0.60 | 2.05 | 1.680 | Example |
| 44 | 0.64 | 2.11 | 1.681 | Example |
| 45 | 0.64 | 2.11 | 1.683 | Example |
| 46 | 0.62 | 2.01 | 1.695 | Example |
| 47 | 0.63 | 2.12 | 1.681 | Example |
| 48 | 0.63 | 2.11 | 1.700 | Example |
| 49 | 0.61 | 2.09 | 1.680 | Example |
| 50 | 0.62 | 2.04 | 1.701 | Example |
| 51 | 0.60 | 2.55 | 1.682 | Comparative Example |

The invention claimed is:

1. A non-oriented electrical steel sheet comprising a chemical composition containing, by mass %, C: 0.0050% or less, Si: 2.0% to 6.0%, Mn: 1.0% to 3.0%, P: 0.20% or less, S: 0.0050% or less, N: 0.0050% or less, and Al: 0.0050% or less, with the balance being Fe and inevitable impurities, wherein Si—Mn nitrides having an average diameter of 50 nm to 500 nm has a number density of 1/μm³ or less.

2. The non-oriented electrical steel sheet according to claim 1, wherein the chemical composition further contains, by mass %, at least one selected from the group consisting of Sn: 0.01% to 0.50% and Sb: 0.01% to 0.50%.

3. The non-oriented electrical steel sheet according to claim 2, wherein the chemical composition further contains, by mass %, at least one selected from the group consisting of Ca: 0.0001% to 0.0300%

Mg: 0.0001% to 0.0300% and,

REM: 0.0001% to 0.0300%.

4. The non-oriented electrical steel sheet according to claim 3, wherein the chemical composition further contains, by mass %, at least one selected from the group consisting of Ni: 0.01% to 5.00% and Co: 0.01% to 5.00%.

5. The non-oriented electrical steel sheet according to claim 2, wherein the chemical composition further contains, by mass %, at least one selected from the group consisting of Ni: 0.01% to 5.00% and Co: 0.01% to 5.00%.

6. The non-oriented electrical steel sheet according to claim 1, wherein the chemical composition further contains, by mass %, at least one selected from the group consisting of Ca: 0.0001% to 0.0300%

Mg: 0.0001% to 0.0300% and,

REM: 0.0001% to 0.0300%.

7. The non-oriented electrical steel sheet according to claim 6, wherein the chemical composition further contains, by mass %, at least one selected from the group consisting of Ni: 0.01% to 5.00% and Co: 0.01% to 5.00%.

8. The non-oriented electrical steel sheet according to claim 1, wherein the chemical composition further contains, by mass %, at least one selected from the group consisting of Ni: 0.01% to 5.00% and Co: 0.01% to 5.00%.

9. A method for manufacturing the non-oriented electrical steel sheet according to claim 1, comprising: hot rolling a slab having the chemical composition as recited in claim 1 to obtain a hot-rolled sheet; coiling the hot-rolled sheet into a coil; cold rolling the hot-rolled sheet once, or twice with intermediate annealing therebetween, to obtain a cold-rolled sheet; and subjecting the cold-rolled sheet to final annealing, wherein the hot-rolled sheet after subjection to the hot rolling is subjected to cooling at an average cooling rate of 30° C./s or higher in a temperature range from 800° C. to 650° C., and then the coiling is performed at 650° C. or lower.

10. A method for manufacturing the non-oriented electrical steel sheet according to claim 1, comprising: hot rolling a slab having the chemical composition as recited in claim 1 to obtain a hot-rolled sheet; coiling the hot-rolled sheet into a coil; subjecting the hot-rolled sheet to hot band annealing and subsequently cold rolling the hot-rolled sheet once, or twice with intermediate annealing therebetween, to obtain a cold-rolled sheet; and subjecting the cold-rolled sheet to final annealing, wherein the hot-rolled sheet after subjection to the hot rolling is subjected to cooling at an average cooling rate of 30° C./s or higher in a temperature range from 800° C. to 650° C., and then the coiling is performed at 650° C. or lower, and the hot-rolled sheet after subjection to the hot band annealing is subjected to cooling at an average cooling rate of 30° C./s or higher in a temperature range from 800° C. to 650° C.

11. A method for manufacturing the non-oriented electrical steel sheet according to claim 2, comprising: hot rolling a slab having the chemical composition as recited in claim 2 to obtain a hot-rolled sheet; coiling the hot-rolled sheet into a coil; cold rolling the hot-rolled sheet once, or twice with intermediate annealing therebetween, to obtain a cold-rolled sheet; and subjecting the cold-rolled sheet to final annealing, wherein the hot-rolled sheet after subjection to the hot rolling is subjected to cooling at an average cooling rate of 30° C./s or higher in a temperature range from 800° C. to 650° C., and then the coiling is performed at 650° C. or lower.

12. A method for manufacturing the non-oriented electrical steel sheet according to claim 2, comprising: hot rolling a slab having the chemical composition as recited in claim 2 to obtain a hot-rolled sheet; coiling the hot-rolled sheet into a coil; subjecting the hot-rolled sheet to hot band annealing and subsequently cold rolling the hot-rolled sheet once, or twice with intermediate annealing therebetween, to obtain a cold-rolled sheet; and subjecting the cold-rolled sheet to final annealing, wherein the hot-rolled sheet after subjection to the hot rolling is subjected to cooling at an average cooling rate of 30° C./s or higher in a temperature range from 800° C. to 650° C., and then the coiling is performed at 650° C. or lower, and the hot-rolled sheet after subjection to the hot band annealing is subjected to cooling at an average cooling rate of 30° C./s or higher in a temperature range from 800° C. to 650° C.

13. A method for manufacturing the non-oriented electrical steel sheet according to claim 6, comprising: hot rolling a slab having the chemical composition as recited in claim 6 to obtain a hot-rolled sheet; coiling the hot-rolled sheet into a coil; cold rolling the hot-rolled sheet once, or twice with intermediate annealing therebetween, to obtain a cold-rolled sheet; and subjecting the cold-rolled sheet to final annealing, wherein the hot-rolled sheet after subjection to the hot rolling is subjected to cooling at an average cooling rate of 30° C./s or higher in a temperature range from 800° C. to 650° C., and then the coiling is performed at 650° C. or lower.

14. A method for manufacturing the non-oriented electrical steel sheet according to claim 6, comprising: hot rolling a slab having the chemical composition as recited in claim 6 to obtain a hot-rolled sheet; coiling the hot-rolled sheet into a coil; subjecting the hot-rolled sheet to hot band annealing and subsequently cold rolling the hot-rolled sheet once, or twice with intermediate annealing therebetween, to obtain a cold-rolled sheet; and subjecting the cold-rolled sheet to final annealing, wherein the hot-rolled sheet after subjection to the hot rolling is subjected to cooling at an average cooling rate of 30° C./s or higher in a temperature range from 800° C. to 650° C., and then the coiling is performed at 650° C. or lower, and the hot-rolled sheet after subjection to the hot band annealing is subjected to cooling at an average cooling rate of 30° C./s or higher in a temperature range from 800° C. to 650° C.

15. A method for manufacturing the non-oriented electrical steel sheet according to claim 8, comprising: hot rolling a slab having the chemical composition as recited in claim 8 to obtain a hot-rolled sheet; coiling the hot-rolled sheet into a coil; cold rolling the hot-rolled sheet once, or twice with intermediate annealing therebetween, to obtain a cold-rolled sheet; and subjecting the cold-rolled sheet to final annealing, wherein the hot-rolled sheet after subjection to the hot rolling is subjected to cooling at an average cooling rate of 30° C./s or higher in a temperature range from 800° C. to 650° C., and then the coiling is performed at 650° C. or lower.

16. A method for manufacturing the non-oriented electrical steel sheet according to claim 8, comprising: hot rolling a slab having the chemical composition as recited in claim 8 to obtain a hot-rolled sheet; coiling the hot-rolled sheet into a coil; subjecting the hot-rolled sheet to hot band annealing and subsequently cold rolling the hot-rolled sheet once, or twice with intermediate annealing therebetween, to obtain a cold-rolled sheet; and subjecting the cold-rolled sheet to final annealing, wherein the hot-rolled sheet after subjection to the hot rolling is subjected to cooling at an average cooling rate of 30° C./s or higher in a temperature range from 800° C. to 650° C., and then the coiling is performed at 650° C. or lower, and the hot-rolled sheet after subjection to the hot band annealing is subjected to cooling at an average cooling rate of 30° C./s or higher in a temperature range from 800° C. to 650° C.

17. A method for manufacturing the non-oriented electrical steel sheet according to claim 3, comprising: hot rolling a slab having the chemical composition as recited in claim 3 to obtain a hot-rolled sheet; coiling the hot-rolled sheet into a coil; cold rolling the hot-rolled sheet once, or twice with intermediate annealing therebetween, to obtain a cold-rolled sheet; and subjecting the cold-rolled sheet to final annealing, wherein the hot-rolled sheet after subjection to the hot rolling is subjected to cooling at an average cooling rate of 30° C./s or higher in a temperature range from 800° C. to 650° C., and then the coiling is performed at 650° C. or lower.

18. A method for manufacturing the non-oriented electrical steel sheet according to claim 5, comprising: hot rolling a slab having the chemical composition as recited in claim 5 to obtain a hot-rolled sheet; coiling the hot-rolled sheet into a coil; cold rolling the hot-rolled sheet once, or twice with intermediate annealing therebetween, to obtain a cold-rolled sheet; and subjecting the cold-rolled sheet to final annealing, wherein the hot-rolled sheet after subjection to the hot rolling is subjected to cooling at an average cooling rate of 30° C./s or higher in a temperature range from 800° C. to 650° C., and then the coiling is performed at 650° C. or lower.

19. A method for manufacturing the non-oriented electrical steel sheet according to claim 7, comprising: hot rolling a slab having the chemical composition as recited in claim 7 to obtain a hot-rolled sheet; coiling the hot-rolled sheet into a coil; cold rolling the hot-rolled sheet once, or twice with intermediate annealing therebetween, to obtain a cold-rolled sheet; and subjecting the cold-rolled sheet to final annealing, wherein the hot-rolled sheet after subjection to the hot rolling is subjected to cooling at an average cooling rate of 30° C./s or higher in a temperature range from 800° C. to 650° C., and then the coiling is performed at 650° C. or lower.

20. A method for manufacturing the non-oriented electrical steel sheet according to claim 4, comprising: hot rolling a slab having the chemical composition as recited in claim 4 to obtain a hot-rolled sheet; coiling the hot-rolled sheet into a coil; cold rolling the hot-rolled sheet once, or twice with intermediate annealing therebetween, to obtain a cold-rolled sheet; and subjecting the cold-rolled sheet to final annealing, wherein the hot-rolled sheet after subjection to the hot rolling is subjected to cooling at an average cooling rate of 30° C./s or higher in a temperature range from 800° C. to 650° C., and then the coiling is performed at 650° C. or lower.

* * * * *